United States Patent [19]

Lehnus

[11] 4,265,606

[45] May 5, 1981

[54] FOSITIVE DISPLACEMENT PULSE FREE ROTARY FLUID PUMP

[76] Inventor: Edward L. Lehnus, 5549 Westwood Northern Blvd., Cincinnati, Ohio 45211

[21] Appl. No.: 96,451

[22] Filed: Nov. 21, 1979

[51] Int. Cl.[3] ..... F04C 2/16

[52] U.S. Cl. ..... 418/201

[58] Field of Search ..... 418/201, 203, 220

[56] References Cited

U.S. PATENT DOCUMENTS

| | | | |
|---|---|---|---|
| 1,927,418 | 9/1933 | Rowlands et al. | 418/201 |
| 2,159,744 | 5/1939 | Maglott | 418/201 |
| 2,530,173 | 11/1950 | Oldberg | 418/201 |
| 3,424,373 | 1/1969 | Gardner | 418/201 |
| 3,865,523 | 2/1975 | Baehr | 418/201 |
| 3,986,801 | 10/1976 | Garland | 418/201 |

*Primary Examiner*—John J. Vrablik
*Attorney, Agent, or Firm*—Frost & Jacobs

[57] ABSTRACT

A positive displacement rotary pump for providing substantially pulse free fluid transfer including a pair of intermeshed cylindrical rotor members having alternating helically arranged ribs and flutes. The pitch and dimensions of the ribs and flutes is such that a rib-flute pair just breaks contact as the adjacent rib-flute makes contact, thereby presenting a substantially constant driving surface to the fluid resulting in continuous fluid flow through the pump. In a preferred embodiment, helical drive gears having teeth pitched oppositely to the rotor member ribs are positioned outside of the fluid flow path to drive one of the rotor members from the other.

4 Claims, 3 Drawing Figures

FOSITIVE DISPLACEMENT PULSE FREE ROTARY FLUID PUMP

SUMMARY OF THE INVENTION

The construction and use of positive displacement rotary pumps for moving fluids or other materials is quite well-known. Traditionally, such pumps have utilized some form of a gear or gear-like rotor, often a star wheel or other type of longitudinally ribbed gear, which intermeshes to provide a forced transfer of fluid. Most of these types of pumps utilize input and output ports located adjacent the intermeshed gears such that the rib spacings or grooves of the gears convey the fluid around the periphery of the housing. It has been found, however, that the fluid is moved in discrete quantities so that separate and distinct discharges or fluid pulsations appear at the pump discharge port. This feature has been found undesirable in applications where a continuous flow of fluid is desired.

The present invention seeks to overcome this disadvantage, among others, of prior art rotary fluid pumps by eliminating the pulsatory or oscillatory effect of the fluid discharge in order to produce substantially pulse-free fluid transfer. In a preferred embodiment, the pump comprises a pump casing having a pair of parallel end walls spaced by a continuous, figure eight-shaped side wall, enclosing a pair of substantially circular intersecting pump chamber cavities. An inlet port extends through the side wall, coaxial with the points of intersection of the cavities. A discharge or outlet port extends through the opposite side wall coaxial with the inlet port.

A substantially cylindrical rotor member is rotatably mounted by the end walls within each of the rotor cavities such that the outer peripheries of the counterrotating rotor members are in rolling contact with each other at a point substantially tangential with the axes of the inlet and outlet ports. Each rotor member includes a plurality of equally spaced parallel semi-cylindrical helically arranged ribs extending outwardly from the outer periphery of the rotor member a distance equal to the radius of the rib, with the outermost edges of the ribs making a sliding seal with the inner surface of the side walls between the inlet and outlet ports. A semi-cylindrical helically arranged flute is positioned in parallel equidistant relationship between each pair of adjacent ribs, each of the flutes extending to a depth equal to the radius of the flute. In a preferred embodiment each of the ribs and flutes extends not more than 360° around the periphery of the rotor.

The ribs and flutes are so arranged that the rib of one rotor member intermeshes with the flute of the adjacent rotor member to form a substantially fluid-tight seal as the rotor members are rotated. The ribs and flutes of each rotor member are pitched in opposite directions, with the pitch of the ribs and flutes being such that the outermost point of each rib adjacent one end wall directly overlies the innermost point on the adjacent flute adjacent the opposite end wall to insure that a rib-flute pair just breaks contact as the adjacent rib-flute pair makes contact.

A helical gear is nonrotatably affixed coaxially with each rotor member, and is positioned outside of the fluid flow path, the gears intermeshing to drive one of the rotor members from the other. The rotors are positioned within their respective rotor cavities such that a sliding seal is produced between the outer faces of the rotor members and the adjacent inner surfaces of the end walls as the rotor member is rotated. A drive shaft or driving means is provided on one of the rotor members in order to rotate that member in such a direction to transfer fluid from the inlet port to the outlet port.

As will be described in more detail hereinafter, the specific construction of the rotor members is such that fluid is transferred between the inlet port and the outlet port in a substantially continuous manner, thereby resulting is substantially pulse-free flow. In other words, the pitch of the ribs and flutes, their semi-cylindrical shape, and the equidistant spacing of these members, insures that one rib-flute pair makes contact just as the adjacent rib-flute pair breaks contact, thereby resulting in a substantially continuous driving surface area presented to the fluid, and consequently continuous fluid flow through the pump.

The helical gears associated with the rotor members not only eliminate the need to drive one rotor member from the other, but also compensate for side thrust forces on the rotor members, thereby reducing rotor wear and resulting in better sealing characteristics for the pump in order to improve efficiency. Furthermore, the helical driving gears are located outside of the fluid flow path, so that pulses are not introduced into the flowing fluid through intermeshing of the gear pair.

Further features of the invention will become apparent from the detailed description which follows:

DETAILED DESCRIPTION

Figure 1:
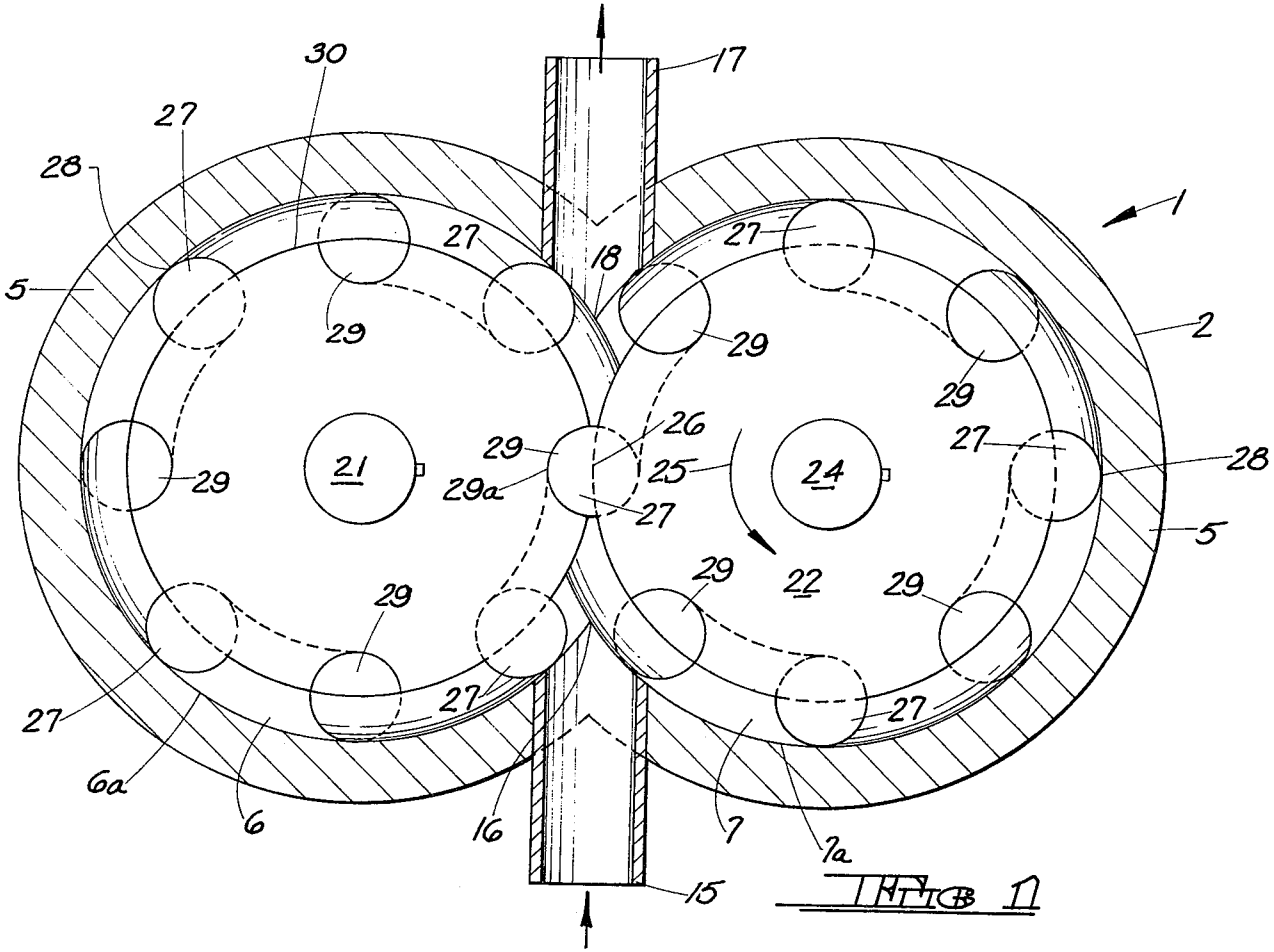
FIG. 1 is a front elevation cross sectional view of the rotary pump of the present invention illustrating the rotors within the pump cavities.

The positive displacement rotary pump, indicated generally at 1, includes a hollow pump casing 2 containing a pair of spaced parallel end walls 3 and 4, connected by a continuous side wall 5. As can best be seen in FIG. 1, side wall 5 is substantially figure eight-shaped, and encloses a pair of intersecting substantially circular pump cavities 6 and 7, having smooth inner walls *6a* and *7a*, respectively. The inner surfaces *6b* and *6c* of pump chamber cavity 6, as well as the inner surfaces *7b* and *7c* of pump chamber cavity 7 are also provided with a smoothly finished surface in order to form sealing surfaces for the pump rotors as will be described in more detail hereinafter.

Pump casing 2 may be constructed of any durable and wear resistent material such as metal, plastic or the like. Furthermore, pump casing 2 may be formed in two or more parts joined by fastening means, not shown, as is well understood in the art.

Figure 2:
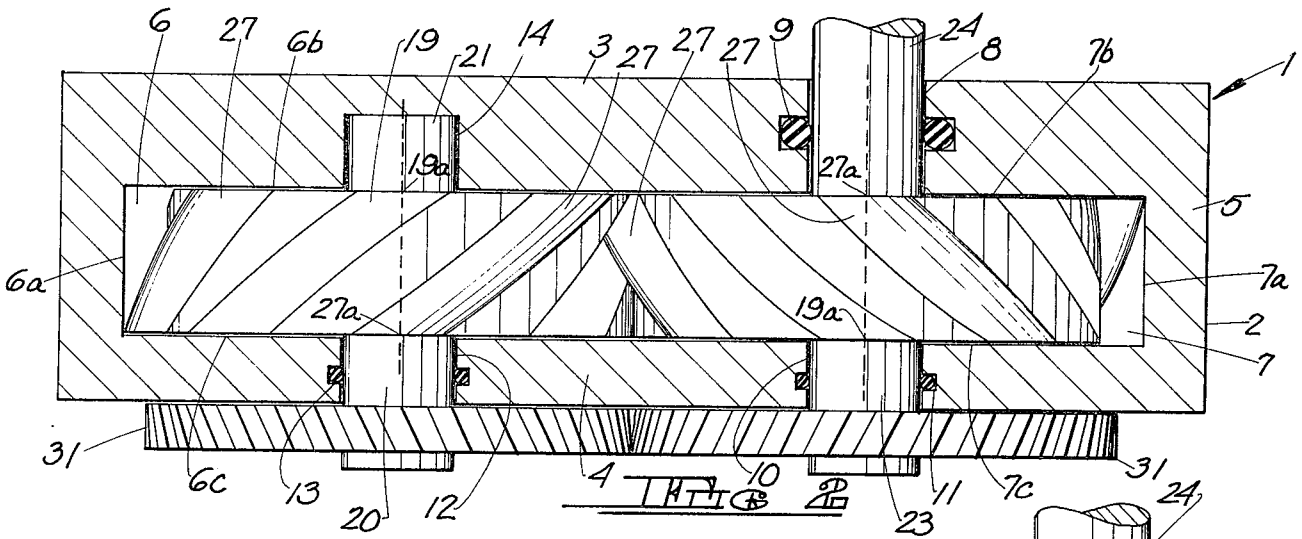
FIG. 2 is a fragmentary cross sectional side elevation view of the rotary pump of the present invention.
Figure 3:
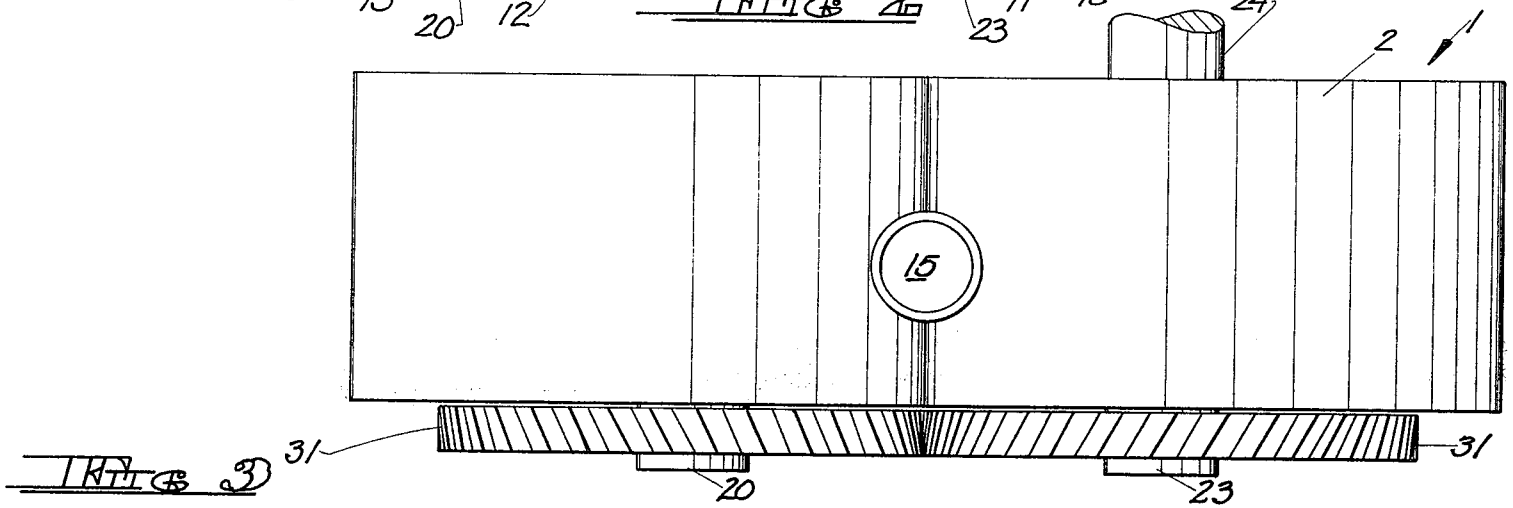
FIG. 3 is a fragmentary side elevation view of the rotary pump of the present invention.

As best shown in FIG. 2, the upper portion of end wall 3 overlying pump chamber cavity 7 is provided with a bore 8 having sealing means such as an O-ring or the like 9 for rotatably supporting a cylindrical drive shaft of one of the rotor members.

The lower end wall 4 is provided with a similar bore 10 coaxial with bore 8 for rotatably mounting the opposite end of the rotor member shaft. Sealing means 11, similar to sealing means 9, may also be provided to prevent escape of fluid from within the pump chamber cavity through the rotor member shaft bearing bores.

Underlying pump chamber cavity 6 is a similar bore 12 extending through the lower end plate 4 for rotatably supporting the lower end of the shaft associated with the other rotor member. Similar sealing means 13 may also be provided as required. End plate 3 is provided with a bore 14 overlying pump chamber cavity 6, which does not extend completely through end plate 3, and is used to rotatably support the opposite end of the shaft associated with the other rotor member. It will be understood that bore 14 may be provided completely through end plate 3 in a manner similar to bore 8, with appropriate sealing means being added as desired. In general, the thicknesses of end plates 3 and 4 will be such as to provide sufficient mechanical strength for the pressures encountered within the rotor chambers, as well as provide sufficient bearing surface for the shafts of the rotor members to prevent end play and the like.

A hollow tube-like inlet port 15 for introducing fluid into the pump 1 extends through side wall 5 coaxial with the cusp-like point of intersection 16 of pump chamber cavities 6 and 7, as best shown in FIG. 1. A hollow tube-like outlet port 17 is positioned coaxial with and opposite inlet port 15 at the cusp-like point of intersection 18 of pump chamber cavities 6 and 7.

A substantially cylindrical rotor member 19 having a pair of outwardly extending cylindrical shafts 20 and 21 is positioned within circular chamber cavity 6. Shaft 20 is rotatably mounted within bore 12 of end wall 4, while shaft 21 is rotatably mounted within bore 14 of end wall 3, thereby permitting rotor member 19 to rotate freely within chamber cavity 6.

A similarly configured substantially cylindrical rotor member 22, having a pair of outwardly extending coaxial shafts 23 and 24 is positioned within cavity 7. Shaft 23 is rotatably secured within bore 10 of end plate 4, while shaft 24, which may be longer than shaft 23, extends within and is rotatably supported by cylindrical bore 8 of end wall 3, thereby permitting rotor member 22 to rotate freely within cavity 7. It will be observed that shaft 24 may be connected to a rotary drive source, not shown, in order to drive rotor member 22 in the direction shown by directional arrow 25 in FIG. 1, when the rotary pump of the present invention is being used as a pump. On the other hand, shaft 24 may be used as a power take-off, when the pump of the present invention is being used as a fluid motor, under the influence of an external source of pressurized fluid, not shown, introduced at inlet port 15, as is well understood in the art.

Counterrotating rotor members 19 and 22 are configured and positioned such that their outer peripheries are in rolling contact with each other at a point 26 substantially tangential to the axes of inlet port 15 and outlet port 17. In other words, the central axis of inlet port 15 and the central axis of outlet port 17, as well as the point of rolling contact 26 between the rotor members lie along a substantially straight line. This insures a rolling seal between the rotor members to prevent fluid from leaking between the portions of the chamber cavities associated with the inlet and outlet ports.

Each rotor member incorporates four equally spaced parallel semi-cylindrical helically arranged ribs 27 extending outwardly from the outer periphery of the rotor member a distance equal to the radius of the rib so that the ribs are substantially semi-circular in cross section. The outermost edges of the semi-cylindrical ribs 27 make a sliding seal as at 28 with the inner surfaces **6*a* and 7*a*** of the rotor cavities. This prevents fluid from leaking around the periphery of the rotor members between the inlet and outlet ports.

Each rotor member also includes four semi-cylindrical helically arranged parallel equally spaced flutes 29 positioned equidistantly between each pair of adjacent ribs 27. Each flute 29 extends to a depth equal to the radius of the flute so that the flutes are substantially semi-circular in cross section. In a preferred embodiment, ribs 27 and flutes 29 extend not more than 360° around the periphery of the rotor. As best shown in FIG. 1, each rotor includes in alternating relationship around its periphery, a rib 27, a smooth surfaced cylindrical portion 30 of the rotor, and a flute 29. It will be observed that this arrangement permits a rib 27 of one rotor member to intermesh with a flute 29 of the other rotor member to form a substantially fluid-tight seal as the rotor members are rotated. Inasmuch as the ribs and flutes are semi-cylindrical in cross section, and of substantially the same diameter, an excellent rolling seal is provided between the flute and rib surfaces to prevent leakage of fluid therebetween. It will also be observed that the ribs and flutes of one rotor member are pitched in opposite directions to the ribs and flutes of the other rotor member. The pitch of the ribs and flutes is such that the outermost point **19*a* on each rib adjacent one end wall directly overlies the innermost point 27*a* on the adjacent flute adjacent the opposite end wall. In other words, and with particular reference to FIG. 1, the point 29*a* at the upper apex of rib 27 is positioned directly above the deepest point of the underlying flute 27** on the opposite rotor member when that particular rib and flute are completely intermeshed. This relationship will occur for each rib-flute pair as the rotor members are rotated, bringing the pairs into intermeshed engagement. This construction insures that a rib-flute pair just breaks contact as the adjacent rib-flute pair makes contact. Consequently, the surface area presented by the ribs to the fluid passed from the inlet port to the outlet port is substantially constant, resulting in a continuous flow of fluid lacking pulses or oscillations as in prior art rotary fluid pumps.

As best shown in FIG. 2, a helical drive gear 31 is non-rotatably affixed to each rotor shaft and is positioned outside of the fluid flow path in order not to introduce pulses or oscillations into the fluid flow stream. Gears 31 are positioned so as to intermesh to drive one of the rotor members from the other. This construction eliminates the need to drive the rotor members by forces exerted between the flutes and ribs, thereby resulting in less wear and better sealing between the rotors. Furthermore, the pitch of the helical gears is arranged opposite to the pitch of ribs 27, thereby eliminating side forces and further improving the wear and sealing characteristics of the pump. It will also be understood that spur or other types of gears may be employed as desired.

The end portions of the rotor members adjacent walls **6*b*, 6*c*, 7*b* and 7*c*, as well as these wall portions themselves are provided with a smoothly finished surface, in order to provide friction free bearing surfaces as well as sealing means between the rotating rotor members and the stationery inner surface of the pump casing 2**. An additional circular bearing plate, not shown, may be provided as required to increase the sealing efficiency.

It has been found that the improved construction of the present invention results in significant advantages over presently known rotary fluid pumps. For example, the specific semi-circular or semi-cylindrical shapes of the ribs and flutes result in longer wiping contact which reduces the amount of slippage between the rotor members, provides better sealing capability and is significantly easier to construct than other previously known shapes, such as elliptical or the like. It has also been found that the pump of the present invention results in higher output flow volumes. Furthermore, the torque or the output volume may be increased by merely increasing the size of the rib and flute. The symmetrical nature of the rotor members balances axial thrust, thereby improving the sealing and wear resistant characteristics of the pump. Finally, the continuous rolling fit between the rotary members results in continuous flow output lacking pulses or oscillations of any type.

It will be understood that various changes in the details, materials, steps and arrangements of parts, which have been herein described and illustrated in order to explain the nature of the invention, may be made by those skilled in the art within the principal and scope of the invention as expressed in the appended claims. For example, while for purposes of an exemplary showing, the present invention has been described and illustrated with four rib-flute pairs, it will be understood that any number of rib-flute pairs may be utilized depending on the particular characteristics required of the pump. Furthermore, the ribs and flutes may extend up to 360° around the periphery of the rotor, provided the other constraints required hereinabove are maintained.

The embodiments of the invention in which an exclusive property or privilege is claimed are as follows:

1. A positive displacement rotary pump for providing substantially pulse-free fluid transfer comprising:

a pump casing having a pair of parallel end walls spaced by a continuous side wall enclosing a pair of substantially circular intersecting pump chamber cavities;

an inlet port extending through said side wall and coaxial with the points of intersection of said cavities;

an outlet port extending through said side wall opposite to and coaxial with said inlet port;

a substantially cylindrical rotor member rotatably mounted by said end walls within each of said cavities such that the outer peripheries of said counterrotating rotor members are in rolling contact with each other at a point substantially tangential with the axes of said inlet and outlet ports, each of said rotor members including:

a plurality of equally spaced parallel semi-cylindrical helically arranged ribs extending outwardly from the outer periphery of said rotor member a distance equal to the radius of said rib, the outermost edges of said ribs making a sliding seal with the inner surface of said side walls between said inlet and outlet ports;

a semi-cylindrical helically arranged flute positioned in parallel equidistant relationship between each pair of adjacent ribs, each of said flutes extending to a depth equal to the radius of the flute, the rib of one rotor member intermeshing with the flute of the other rotor member to form a substantially fluid-tight seal as said rotor members are rotated, the ribs and flutes of each rotor member being pitched in opposite directions, the pitch of said ribs and flutes being in opposite directions such that the outermost point of each rib adjacent one side wall directly overlies the innermost point on the adjacent flute adjacent the opposite side wall to insure that a rib-flute pair just breaks contact as the adjacent rib-flute pair makes contact.

a gear coaxial with and non-rotatably affixed to said rotor member, said gears being positioned outside of the fluid flow path and intermeshing to drive one of said rotor members from the other;

means for providing a seal between the outer faces of said rotor member and the adjacent inner surfaces of said end wall as said rotor member is rotated; and means associated with one of said rotor members for driving said rotor members in a direction to transfer fluid in a pulse-free manner from said inlet port to said outlet port.

2. The positive displacement rotary pump according to claim 1 wherein each of said ribs and said flutes extends not more than 360° around the periphery of said rotor member.

3. The positive displacement rotary pump according to claim 1 wherein said gears are helical gears.

4. The positive displacement rotary pump according to claim 3 wherein the pitch of said helical gears is opposite to the pitch of said helically arranged ribs.

* * * * *